United States Patent [19]

Autere

[11] 4,408,547

[45] Oct. 11, 1983

[54] HEATING BOILER

[76] Inventor: Ilpo Autere, Keksikuja 4, 86300 Oulainen, Finland

[21] Appl. No.: 359,668

[22] PCT Filed: Jul. 6, 1981

[86] PCT No.: PCT/FI81/00054

§ 371 Date: Mar. 8, 1982

§ 102(e) Date: Mar. 8, 1982

[87] PCT Pub. No.: WO82/00187

PCT Pub. Date: Jan. 21, 1982

[30] Foreign Application Priority Data

Jul. 7, 1980 [FI] Finland ..... 802162

[51] Int. Cl.[3] ..... F23B 7/00

[52] U.S. Cl. ..... 110/234; 110/246; 110/294; 126/181

[58] Field of Search ..... 110/294, 276, 234, 246; 126/181, 165

[56] References Cited

U.S. PATENT DOCUMENTS 2,426,348 8/1947 Fulton et al. ..... 110/276
2,496,156 1/1950 Fulton ..... 110/276
3,368,505 2/1968 Harrison ..... 110/246
3,376,833 4/1968 Mutchler ..... 110/246 X
3,646,898 3/1972 Bauers ..... 110/246

*Primary Examiner*—Edward G. Favors

[57] ABSTRACT

The invention concerns a heating boiler operating on solid, comparatively finely divided fuel, such as chips or peat, and which is used to produce hot water or steam. The boiler comprises a furnace, in which the grate consists of a shell-like burning basket, which can be placed in rotary motion about its substantially horizontal axis. The rotating of the burning basket may be arranged by connecting to the basket a tubular arm provided with a gear wheel and which is connected to a motor placed outside the boiler. The arm then simultaneously serves as duct through which the fuel is introduced into the burning basket. The purpose of the rotating burning basket is to boost the combustion reaction so that comparatively wet fuel can be used in the boiler. The combustion may furthermore be boosted by placing the burning basket in the furnace in a housing having as its extension a cyclone constituting a helical exhaust duct for the flue gases, which sets the gases at high temperature into strongly turbulent motion.

3 Claims, 3 Drawing Figures

HEATING BOILER

Figure 1:
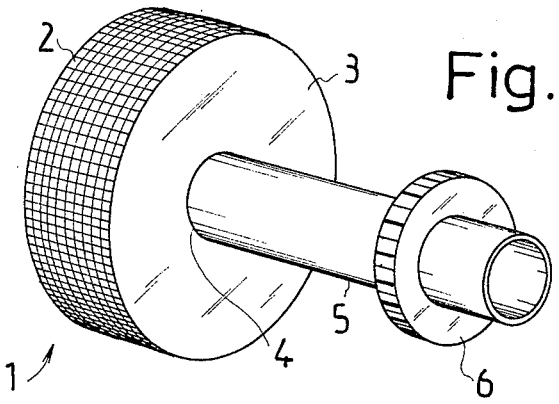

The present invention concerns a heating boiler intended for solid fuel and comprising a furnace and a feeding means to the purpose of feeding fuel onto the grate in the furnace.

In prior art heating boilers using solid fuel such as peat or chips are known in which the feeding of fuel into the boiler furnace is with the aid of mechanical conveyors. The problem in using said fuels is however that they often contain a considerable amount of moisture, which retards the combustion. In some boilers, in an attempt to solve this problem, the fuel is dried with the aid of hot combustion gases conducted from the furnace. In that case the fuel feed ducts and the set of flue gas exhaust conduits have to be interconnected in a way which renders the boiler comparatively complex of its construction.

The object of the present invention is to provide a heating boiler in which moist fuel can be burned, even green chips if required, without necessity to perform any drying of the fuel prior to its introduction into the boiler furnace. The invention is based on constructing the grate in the furnace in a way by which is achieved sufficient boosting of the combustion reaction, and it is characterized in that the grate consists of a shell-like burning basket into which the fuel can be supplied and which can be set in rotary motion about its substantially horizontal axis. The rotating burning basket disperses the fuel over a wider area so that it is brought into the most efficient contact possible with the combustion air. By keeping the burning basket in constant motion, one prevents the accumulation of fuel on one spot, whereby further the starting of the combustion reaction is speeded up.

One embodiment of the heating boiler of the invention is characterized in that to the burning basket has been connected an arm parallelling the axis of the basket and connected over a gear wheel with the motor rotating the burning basket. It is to advantage in connection with this problem solution to shape said arm to be a hollow tube extending out from the boiler. In that case the mechanism rotating the burning basket constitutes no obstacle whatsoever to the feeding operation.

Another embodiment of the heating boiler of the invention is characterized in that the burning basket consists of net-like material. The advantage is then that the fuel, which comes in a granulate-resembling form, is caught in the net, which to a considerable extent prevents the sliding down of the fuel as the burning basket rotates. The net constitutes an ideal combustion base also in the respect that the fuel is all the time in complete unobstructed contact with the combustion air.

The invention may also be advantageously applied so that the burning basket is encircled by a housing having as its extension a cyclone fitted with a helical flue gas exhaust duct. The heating boiler may then be furnished with a duct through which the combustion air is blown into the housing, and the helical exhaust duct, where the combustion gases that are produced are set in rotary, accelerating motion, efficiently brings the combustion reaction to its completion and prevents ash from accumulating in the housing.

Figure 2:
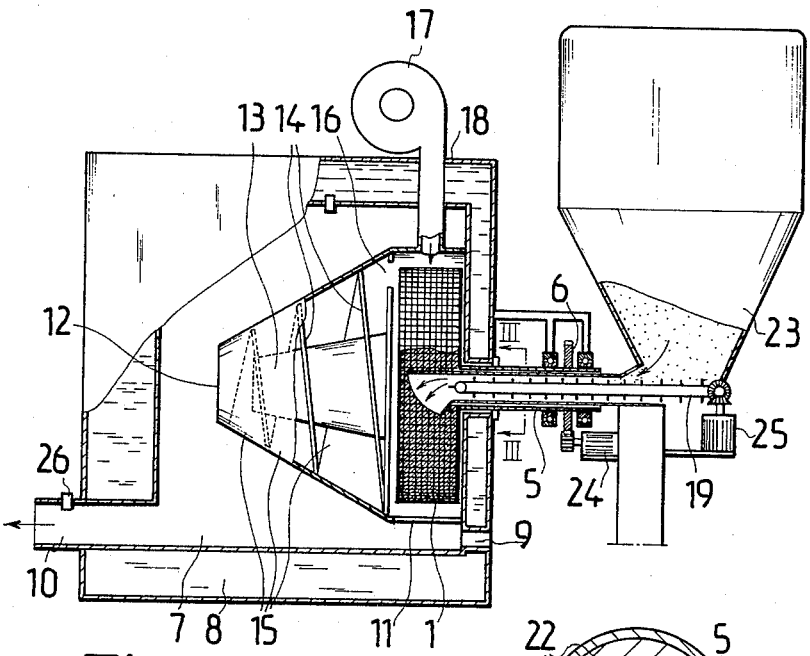
Figure 3:
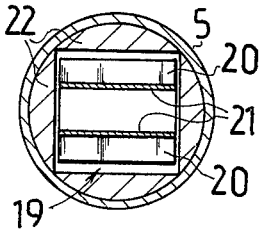

The invention is described in detail in the following with the aid of an example and with reference to the attached drawing, wherein:

FIG. 1 presents the rotating burning basket and the arm thereto attached with its gear wheel;

FIG. 2 shows, partly sectioned, the furnace of the heating boiler, provided with a burning basket as depicted in FIG. 1 and with a fuel dispensing apparatus; and FIG. 3 shows the section along line III—III in FIG. 2.

In FIG. 1 has been depicted the rotating burning basket 1 constituting the grate of a heating boiler using mainly chips or milled peat, said burning basket comprising a cylindrical mantle 2 of metal netting, confined at both ends by a circular plate, or disk, 3. One of said disks has an aperture 4, to which has been affixed a horizontal, tubular arm 5. Close to the end of the arm has been mounted a gear wheel 6, by which the arm is connectable to the motor rotating the burning basket 1.

In FIG. 2 is seen the furnace 7 of the heating boiler, its grate consisting of the rotating burning basket 1 above described. The furnace 7 is enclosed within a water jacket 8, which absorbs the heat generated by the boiler, an ash hole 9 and the initial end of the flue gas removing duct 10 having been disposed on the bottom of the furnace. The rotating burning basket 1 has been encircled, in the furnace 7, with a cylindrical housing 11 having as its extension a cyclone 12, serving as exit path for the flue gases. The cyclone 12 comprises a gently converging inner cone 13 and a helical partition 14, which forms between the inner cone and the mantle of the cyclone a helical flue gas exhaust duct 15. This duct communicates by an aperture 16 with the housing 11 and it tapers down towards the end of the cyclone 12 in such manner that the speed of the departing flue gases increase in the duct. The inner cone 13 communicates with the housing 11, whereby its temperature rises to great height during the combustion process, and this ensures complete combustion in the turbulent gas flow taking place in the exhaust duct 15. Over the housing 11 an oil burner 17 has been disposed, communicating by the duct 18 with the housing.

The means supplying fuel into the furnace 7 consists of a conveyor 19, which has been disposed within the hollow, tubular arm 5 connecting with the burning basket 1 and extending out from the boiler. The conveyor 19 consists of an endless belt 21 provided with spikes 20, visible in section in FIG. 3. Between the conveyor 19 and the rotating arm 5, seals 22 have been fitted, as shown in FIG. 3. One end of the conveyor 19 has been connected to the fuel hopper 23, and the other end is placed adjacent to the aperture 4 in the disk 3 confining the burning basket, so that the fuel can fall down to the bottom of the burning basket. The motor 24 rotating the burning basket 1 over the arm 5 and the gear wheel 6 has been placed outside the boiler, as shown in FIG. 2.

The heating boiler just presented can be automated, in which case it operates as follows. The burner 17 is to begin with run with fuel oil, and the motor 24 rotating the burning basket 1 starts at this time. When these actions have been going on for a certain time, the motor 25 of the conveyor 19 starts. The conveyor now begins to transport fuel from the burner 23 to the burning basket 1, where it is ignited by the flame from the burner 17. The oil pump of the burner 17 then becomes switched off so that the boiler will thenceforward operate exclusively on the solid fuel introduced by the conveyor 19 and on oxygen blown in through the duct 18. The speed of rotation of the conveyor motor 25 is controlled on the basis of the flue gas temperature sensed by the thermostat 26, so that the motor speed is reduced by the control automatics when a given temperature limit is exceeded. As a result, the fuel introduction rate goes down, and the flue gas temperature is correspondingly lowered. If on the other hand the flue gas temperature falls below a predetermined limiting value, the automatics increase the fuel introduction rate by increasing the speed of the motor.

It is obvious to a person skilled in the art that different embodiments of the invention are not confined to the example presented above and that they may instead vary within the scope of the claims following below. For instance, it is possible to mount the burning basket and the tubular arm connecting therewith in a slightly inclined position, e.g. so that the arm slopes downward at an angle about 3 to 4 degrees, whereby the rotating arm serves as automatic fuel feeding means and no separate conveyor is needed. It is further possible to construct in the mantle of the cyclone serving as exit path for the flue gases, a preferably helical duct through which is conducted water which one desires to heat. The duct runs in counterdirection to the gas flow, thus forming a heat exchanger operating according to the countercurrent principle and by the aid of which superheated steam may be generated. If the duct is provided with branch pipes and with check valves placed at the points where they branch off, superheated steam may be drawn from the boiler as required, at different pressures and temperatures. Such a duct connected to the cyclone may even replace the entire water jacket encircling the furnace, as in the preceding example.

I claim:

1. A heating boiler intended for solid fuel and comprising a furnace, a cylindrical burning basket having a generally horizontal axis, said burning basket serving as grate of the furnace, and a hollow tube connected to the burning basket and extending in the direction of the axis of the basket to the outside of the boiler, said tube serving as means for communicating a rotary movement to the basket and forming a channel through which fuel is supplied to the basket.

2. A heating boiler according to claim 1, comprising a gear wheel for connecting the tube with a motor providing the rotary movement.

3. A heating boiler according to claim 1, comprising a housing encircling the burning basket, said housing having as its extension a cyclone provided with a helical flue gas exhaust duct.

* * * * *